US006164565A

United States Patent [19]

Adee et al.

[11] Patent Number: 6,164,565

[45] Date of Patent: Dec. 26, 2000

[54] SPRAY NOZZLE APPARATUS

[75] Inventors: Patrick Gerald Adee, Bloomingdale; Charles Raymond White, Parsippany, both of N.J.

[73] Assignee: Reckitt Beneckiser Inc., Wayne, N.J.

[21] Appl. No.: 08/996,640

[22] Filed: Dec. 23, 1997

[30] Foreign Application Priority Data

Aug. 15, 1997 [GB] United Kingdom ..... 9717216

[51] Int. Cl.[7] ..... A62C 11/00

[52] U.S. Cl. ..... 239/333; 239/451; 239/428.5; 239/390

[58] Field of Search ..... 239/333, 451, 239/343, 428.5, 512, 462, 553.3, 390, 587.1, 587.2, 575, 468, 590.3; 222/190, 211, 383.1

[56] References Cited

U.S. PATENT DOCUMENTS

| | | | |
|---|---|---|---|
| 4,779,803 | 10/1988 | Corsette | 239/428.5 |
| 4,789,103 | 12/1988 | Ruhnke | 239/428.5 |
| 4,883,227 | 11/1989 | Maas | 239/333 |
| 5,366,160 | 11/1994 | Balderrama | 239/333 |
| 5,373,991 | 12/1994 | Nelson | 239/333 |
| 5,431,345 | 7/1995 | Lund et al. | 239/329 |
| 5,467,929 | 11/1995 | Bosio | 239/428.5 |
| 5,647,539 | 7/1997 | Dobbs et al. | 239/504 |

FOREIGN PATENT DOCUMENTS

| | | | |
|---|---|---|---|
| 0391050 | 10/1990 | European Pat. Off. | 239/390 |
| 0 718 041 A1 | 6/1996 | European Pat. Off. | B05B 7/00 |

OTHER PUBLICATIONS

Copy of GB Patent Office Search Report for GB Application No. 9717216.7 dated Nov. 7, 1997.

*Primary Examiner*—Andres Kashnikow
*Assistant Examiner*—Dinh Q. Nguyen
*Attorney, Agent, or Firm*—Fish & Richardson P.C.

[57] ABSTRACT

An improved means for modifying the spray characteristics of a liquid to be sprayed from a container, such as a manually pumpable container or a pressurized container such as an aerosol container which comprises a first fitment element which includes a first fluid flow modifying element mountable substantially perpendicular to the flow path of the liquid to be sprayed which comprises a plurality of spaced apart beams having intermediate transverse passages therebetween, and, a second fitment element which includes a second fluid flow modifying element rotatably mounted on the first fluid flow modifying element and perpendicular to the flow path of the liquid to be sprayed where the second fluid flow modifying element comprises a plurality of spaced apart beams having intermediate transverse passages therebetween, where the second fitment element may be variably rotatably oriented with respect to the first fitment element. Rotation of the second fluid flow modifying element with respect to the first fluid flow modifying element allows for the adjustment and variation in the foaming of the liquid being delivered.

The improved means are particularly useful in conjunction with devices for dispensing liquid compositions i.e., hard surface cleaning compositions, disinfectant compositions, and the like.

21 Claims, 6 Drawing Sheets

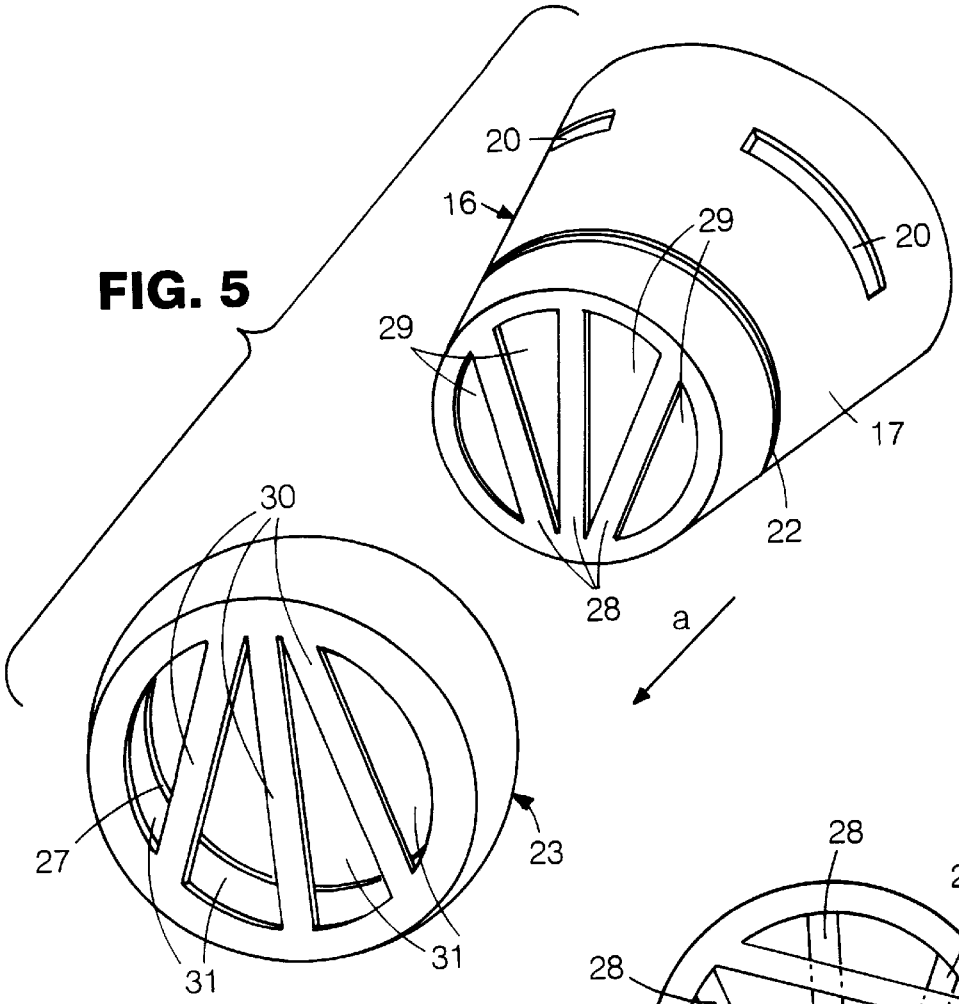
FIG. 5
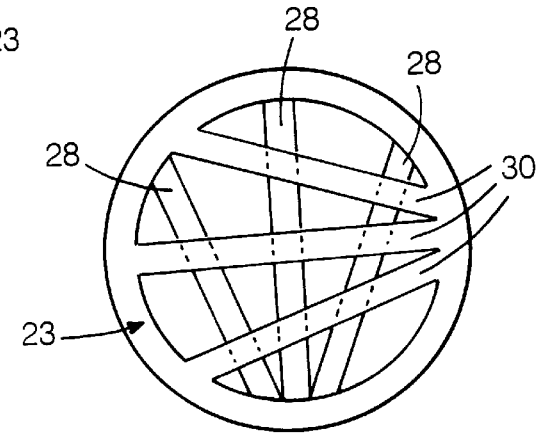
FIG. 6
FIG. 7
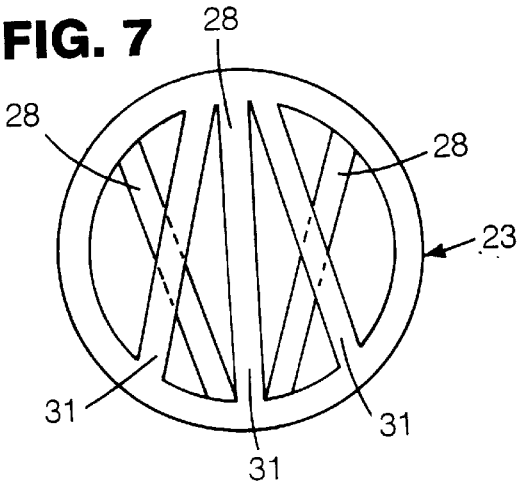

SPRAY NOZZLE APPARATUS

The present invention relates to manually operable pump apparatus used for dispensing a liquid from a container vessel.

Various approaches have been suggested in the prior art in order to improve the foaming delivery characteristics of such manually operable pump mechanisms. One solution suggested by the art is the use of an interposed dispensing fitment which is placed after the exit nozzle of a pump apparatus which fitment includes a screen element which is placed a small distance downstream from the exit nozzle. The fluid stream exiting the nozzle is a substantially linear stream of the liquid product which, but for the interposed fitment would be provided as a narrow stream. However, the dispensing fitment interposes a screen element having small square apertures, said screen element being substantially perpendicular to the flow stream exiting the nozzle. Said fluid stream, upon passing through the screen is widely dispersed and entrained air entering the dispersed stream acts to favorably cause turbulence to be imparted upon the fluid stream and induces foaming of the delivered liquid composition. The consumer sees the delivery of a foamed product as it is dispensed from the device onto a surface. The prior art also has a fitment which has a hinge included therein. In such a prior art apparatus, the screen may be hinged out of the direction of the fluid stream exiting the nozzle so that the delivered product is provided in a streamwise fashion. When a foamed delivery is required or desired, the screen is merely reintroduced downstream of the nozzle and interposed before the fluid stream. Such overcomes the problem of a single delivery pattern, however, an unfavorable from a consumer standpoint is very frequently a quantity of the liquid product collects in such a hinged fitment and is known to drip onto the users hands. Also, the changeover from a fluid stream spray pattern to a high foaming spray pattern requires that the consumer swing the hinged element at the end of the fitment. This is also frequently undesirable as the user is required to physically contact the liquid composition being dispensed.

Accordingly, the present invention provides an improved manually operable pump mechanism for use in conjunction with a container vessel containing a quantity of a liquid composition. This mechanism includes a first flow modifying element interposed downstream of, and substantially perpendicular to the direction of the fluid stream exiting the nozzle of said pump mechanism,. The mechanism further includes and a second fluid flow modifying element further downstream from the first fluid flow modifying element which is also interposed in the stream exiting the nozzle. The positions of these fluid flow modifying elements may be variably oriented relative to each other. The relative positions of these fluid flow modifying elements may be used to establish various degrees of foaming of the fluid product being delivered.

In preferred embodiments at least one of these elements is rotatable with respect to the other fluid flow modifying element at least 90 degrees of rotation, preferably at least 180 degrees of rotation, thereby permitting variability in the relative orientation of these first and second elements. In a first preferred embodiment, the first fluid flow modifying element and the second fluid flow modifying element are each substantially planar and said planes of the fluid flow modifying elements are parallel to each other. In a second preferred embodiment one or both of the first fluid flow modifying elements and the second fluid flow modifying elements are concave or convex elements. In any of the preferred embodiments, the first and second fluid flow modifying elements may contact one another, or they may be spaced apart.

In a further embodiment of the invention there is also provided a method for providing a high foaming delivery characteristic to a liquid dispensed from a container vessel. This method includes the process step of providing a manually operable pump mechanism as described above, operating said pump mechanism wherein said first and second fluid flow modifying elements are in a first operating position relative to each other, as well as further operating the pump mechanism wherein said first and second fluid flow modifying elements are positioned in a second operating position relative to one another which is different from said first operating position.

These and other aspects of the invention are described in more detail below.

FIG. 5 illustrates in a perspective view a second preferred embodiment of the first fluid flow modifying element and the second fluid flow modifying element according to the invention.

FIG. 6 illustrates an end view of part of the elements illustrated on FIG. 5 where the first fluid flow modifying element and the second fluid flow modifying element are in a first orientation relative to each other.

FIG. 7 illustrates an end view of part of the elements illustrated on FIG. 5 where the first fluid flow modifying element and the second fluid flow modifying element are in a first orientation relative to each other.

With respect to the elements indicated in the various Figures, it is to be understood that similar elements are uniformly referenced by common reference numbers.

Figure 1:
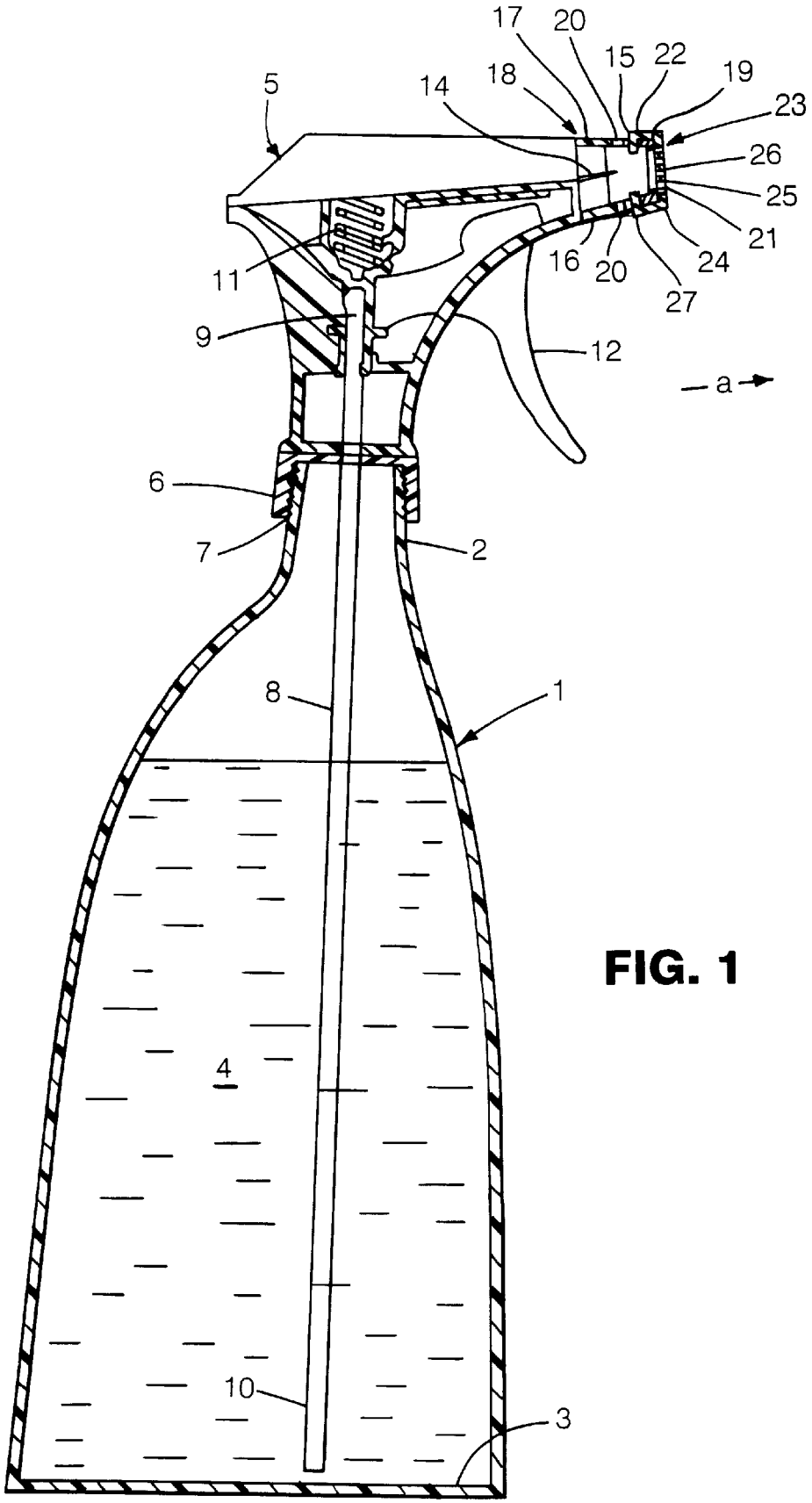
FIG. 1 illustrates a side and partial cut-away view of a first preferred embodiment of the invention.

Turning to FIG. 1 there is illustrated a preferred embodiment of the present invention. Thereupon is illustrated a container vessel (1) having a neck (2) a bottom (3) which substantially define the confines of the container vessel. The container vessel also typically includes a quantity of a liquid composition (4) contained within. The apparatus also includes a manually operable pump mechanism generally referred to (5) which includes a rotatable collar (6) at the base thereof which includes mating threads (7) which are desirably also present at the exterior periphery of the neck of the container vessel. Such a collar provides an easy method wherein a fluid tight connection between the manually operable pump apparatus (5) and the container vessel (1) may be achieved, but other means and devices accomplishing the same result may also be used. The manually operable pump mechanism further includes a dip tube (8) having a first end (9) in fluid communication with a pump chamber (11) and a second end (10) extending downwardly into the interior of the container vessel wherein it is immersed in the liquid composition. The manually operable pump mechanism further includes a trigger (12) which is intended to be grasped by one or more fingers of a user's hand and compressed to operate the manually operable pump mechanism. Upon such operation, a quantity of the liquid composition is drawn upward through the dip tube through said pump chamber (11) and is forced out through a nozzle (14) past a nozzle exit orifice (15). The direction of fluid flow is indicated by the arrow "a". According to the preferred embodiment, attached to or formed as an integral part of the manually operable pump mechanism is a first fitment element (16).

According to a first preferred embodiment of the invention, this first fitment element (16) includes at least one side wall (17) which has an end (18) which is connected to, or abuts a portion of the manually operable pump mechanism and is desirably rigidly connected thereto. The first fitment element also includes an end wall (19) which depends from the side wall (17) opposite the end (18) and is substantially perpendicular to the one or more side walls (17). With regard to the one or more side walls it is to be understood in a cross-sectional view, i.e., perpendicular to the direction of the nozzle and perpendicular to the direction of fluid flow, the first fitment element may take a variety of configurations including circular, in which there is only one side wall (17), as well as square or rectangular, wherein there are four side walls (17). Other cross-sectional geometries may also be used, but most desirably for ease of construction as well as ease of ultimate use, a substantially circular cross-section is selected. Passing transversely through the side wall (17) it is optional, but desirable to also include one or more vent passages (20) which permit the introduction of air from the exterior through said vent passage(s) (20) and into the interior of the first flow modifying element (21) which is a part of the end (18). Optionally, but also desirably, the first fitment element (16) also includes an annular locking element (22), which is preferably a circumferential groove which desirably extends circumferentially completely about the exterior of the side wall (17) and is adapted to receive one or more corresponding elements such as an annular ring, a tab, a lug or other element engageable with the annular locking element (22).

This first preferred embodiment of the apparatus according to the invention further includes a second fitment element (23) which includes one or more side walls (24) as well as an end (25) within which or part of which is the second fluid flow modifying element (26). According to this preferred embodiment, the second fitment element is configured such that it encases the end (18) and at least part of the side wall (17) of the first fitment element (16) and is rotatable thereabout. Such is easily achieved by the use of one or more locking element(s) (27) which extend towards the interior of the second fitment element and are correspondingly dimensioned to be slidably fittable within the annular locking element (22), desirably a circumferential groove of the first fitment element (16). Such locking element or elements (27) may be for example, one or more inwardly extending tabs, rings, protrusions, or circumferential elements such as a ring-shaped element intended to be inserted into and engage at least part of the annular groove (22) of the first fitment element (16). Other means for providing such a rotatable fit between the first fitment element (16) and the second fitment element (23) may also be suitably used. According to the presently discussed preferred embodiment, the second fluid flow modifying element (26) is rotatable at least 90°, more desirably is rotatable at least 180° and most desirably is rotatable 360° about the first fluid flow modifying element (21), which elements are parallel with respect to one another.

Whereas, it is illustrated in FIG. 1 that the end (18) of the first fitment element (16), and the first fluid flow modifying element (21) abuts the second fluid flow modifying element (26) of the second fitment element (23), it is to be clearly understood that this relationship may also vary. According to one such preferred variation, the dimensions of the second fitment element (23), namely the length of the side walls (24) are increased such that when the one or more locking elements (27) and the annular locking element (22) are engaged, a space is present between the end (18) and the end (25) and thereby a spaced apart relationship is maintained between the first fluid flow modifying element (21) and the second fluid flow modifying element (26). As is seen from FIG. 1, according to this preferred embodiment the first fluid flow modifying element (21) and the second fluid flow modifying element (26) are each substantially planar, and parallel with respect to one another. Likewise, it is understood from FIG. 1 that the direction of fluid flow is substantially perpendicular to both the first and second fluid flow modifying elements.

Figure 2:
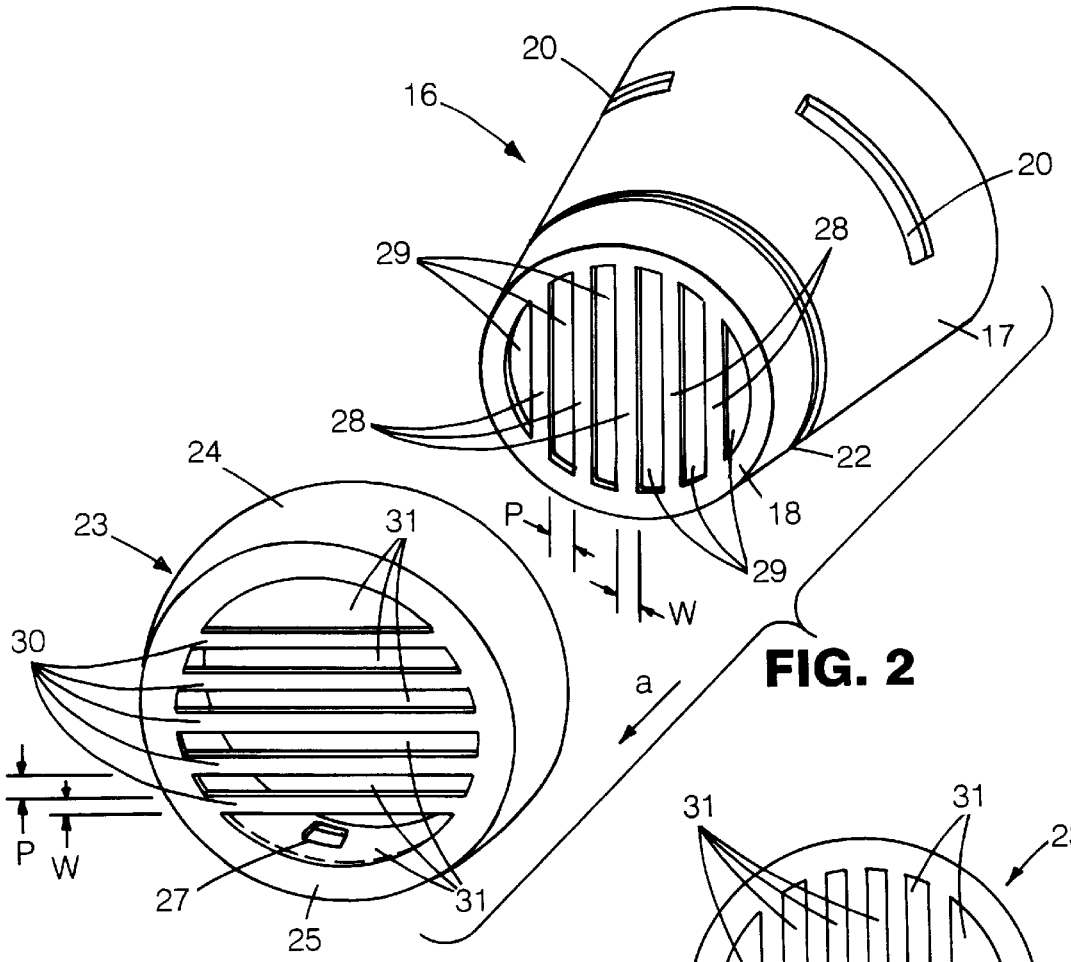
FIG. 2 illustrates in a perspective view a first preferred embodiment of the first fluid flow modifying element and the second fluid flow modifying element according to the invention.

Turning now in more detail to the improvements provided by the invention, on FIG. 2 there is depicted an expanded, perspective view of a first fitment element (16) and second fitment element (23) according to the present invention. With regard to the first fitment element, there is also depicted the most preferred embodiment of the annular locking element (22), a circumferential recess extending completely about the exterior of the side wall (17). As is more clearly seen, the end (18) incorporates therein the first fluid flow modifying element which is comprised of the transverse beams (28) in conjunction with the intermediate transverse passages (29). As may be seen according to this preferred embodiment, the transverse beams (28) are parallel with respect to one another and are in the form of parallelly spaced apart cords which extend across the circular cross-section of the end (18) and bridge the side wall (17). Each of these transverse beams illustrated in FIG. 2 is of a uniform width having a dimension "w", and similarly the transverse passages intermediate the transverse beams also have a width "p". The width of each of these transverse beams as well as the width of the transverse passages are substantially the same, and "w" is approximately equal to "p". Also depicted are two vent passages (20) extending through the side wall (17). Turning now to the second fitment element (23), therein is also provided a further side wall (24) which is dimensioned to encase a portion of the side wall (17) of the first fitment element (16), an end (25)

which incorporates in its construction the second fluid flow modifying element. Said second fluid flow modifying element comprises a plurality of parallelly positioned transverse beams (30) and further comprises a plurality of transverse passages (31). As may be seen according to this preferred embodiment, the transverse beams (30) are parallel with respect to one another and are in the form of parallelly spaced apart cords which extend across the circular cross-section of the end (25) and bridge the further side wall (24). Each of these transverse beams (30) is of a uniform width having a dimension "w", and similarly the transverse passages intermediate the transverse beams also have a width "p". The width of each of these transverse beams as well as the width of the transverse passages are substantially the same, and "w" is approximately equal to "p". Also further seen in FIG. 2 is an exemplary locking element (27), here having the form of an inwardly extending tab element dimensioned to engage and to mate with at least a part of the annular locking element (22) of the first fitment element (16). While not shown, at least one further locking element (27) is also to be understood to be present.

In use, the second fitment element (23) is pushed upon the first fitment element such that the locking element(s) (27) are engaged within the annular locking element (22). This provides a rotatable mechanical connection between the respective first and second fitment elements (16), (23). Thereafter, the first fitment element (16) is affixed to a part of the manually operable pump mechanism (5) such that first and second flow modifying elements are substantially perpendicular to the direction of the fluid stream exiting the nozzle orifice of the said pump mechanism (5). Generally, this is substantially perpendicular to the axis of the nozzle (14), and in the flow path of the liquid to be sprayed out from the pump mechanism (5). This affixation may be accomplished by a variety of conventional means such as having locking or mating elements on a part of the first fitment element which match or mate into a part of the manually operable pump mechanism, or for example, the first fitment element (16) of the assembled first and second fitment element may be glued to a portion of the manually pump mechanism (5).

According to the apparatus and process of the invention, the user of the manually operable pump mechanism (5) may establish various fluid delivery patterns delivered by said pump mechanism. This pattern is infinitely variable between a substantially nonfoaming fluid stream flow delivery pattern, and a "high foaming" spray pattern. This may be accomplished by rotating the second fitment element (23) with respect to the first fitment element (16) which also acts to rotate the respective second fluid flow modifying element (26) with respect to the first fluid flow modifying element (21). This operation is partially described in conjunction with FIGS. 3 and 4, as well as FIGS. 3A and 4A.

Figure 3:
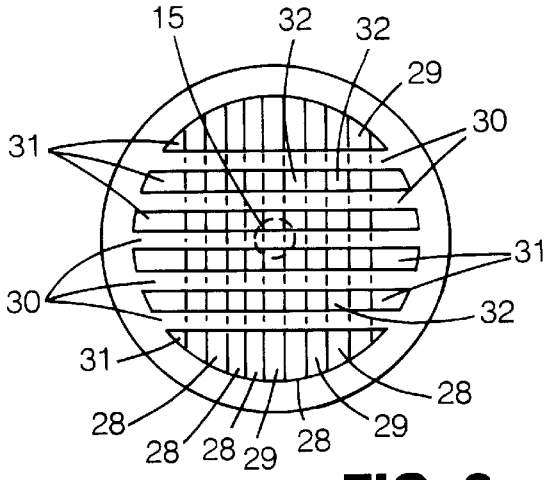
FIG. 3 illustrates an end view of part of the elements illustrated on FIG. 2 where the first fluid flow modifying element and the second fluid flow modifying element are in a first orientation relative to each other.

Turning now to FIG. 3, therein is illustrated an end view of the fitment apparatus according to FIG. 2, wherein transverse beams (30) as well as the transverse passages (31) forming parts of the second fitment element (23) are substantially perpendicular to the direction of transverse beams (28) and transverse passages (29) forming parts of the first fitment element (16). As may be seen from FIG. 3, such an arrangement thereby defines a plurality of substantially-square exit passages (32) in at least the region of, (that is to say, in front of, or forward of) the nozzle exit orifice (15) from which the liquid composition exits. According to the configuration depicted in FIG. 3, a high foaming spray effect is provided according to this relative positioning of the first fitment element (16) and second fitment element (23).

Figure 4:
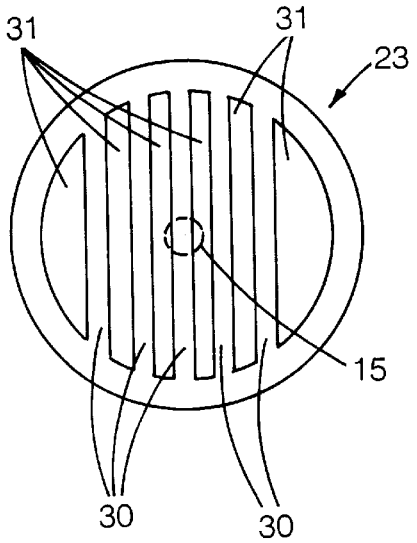
FIG. 4 illustrates an end view of part of the elements illustrated on FIGS. 2 and 3 where the first fluid flow modifying element and the second fluid flow modifying element are in a second orientation relative to each other.

A second orientation of the first fitment element and second fitment element is depicted in FIG. 4. Therein, as can be seen, the second fitment element (23) is positioned such that the transverse beams (30) and transverse passages (31) overlap (and in this figure obscure) the corresponding transverse beams and transverse passages of the first fitment element. As such, the fluid composition exiting the nozzle exit orifice (15) is provided with a lesser obstructed passage permitting the exit of the fluid composition to be delivered in its most fluid stream-like delivery pattern.

Various alternative embodiments of the device according to the invention are also possible and considered to be within the scope of this present invention.

Figure 3A:
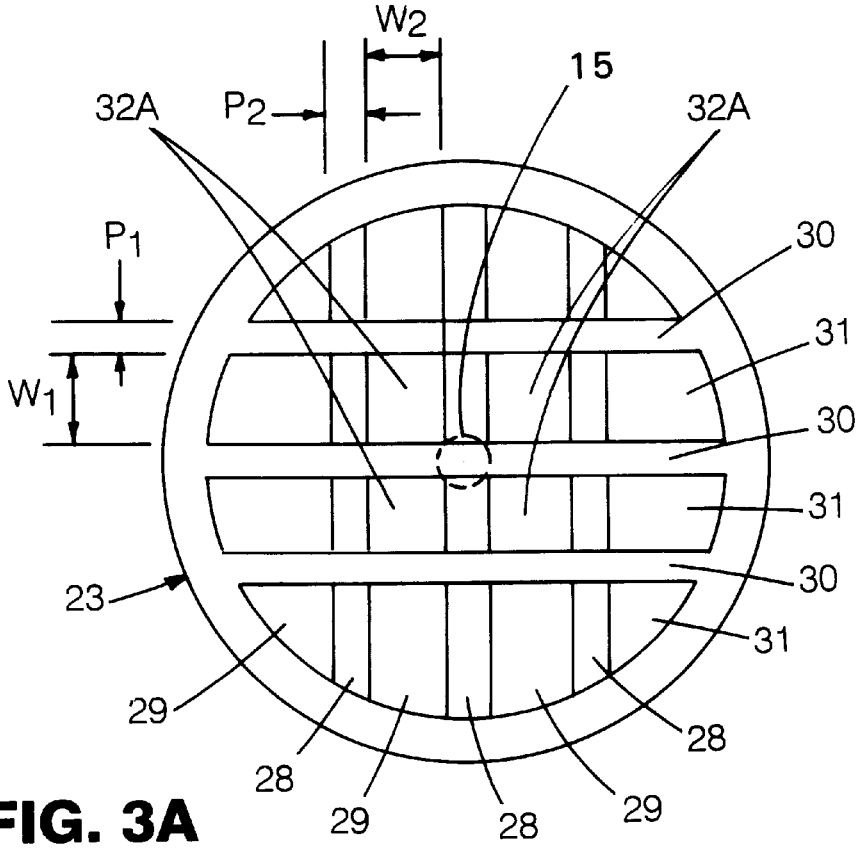
FIG. 3A illustrates in an end view an alternative embodiment of fluid flow modifying elements illustrated on FIG. 2.

Turning now to FIG. 3A, therein is illustrated an end view of the fitment apparatus in many ways similar to the embodiment illustrated on FIG. 2. Depicted are transverse beams (30) as well as the transverse passages (31) defined therebetween form parts of the second fitment element (23) which are substantially perpendicular to the direction of transverse beams (28) and transverse passages (29) defined therebetween forming parts of the first fitment element. As may be seen from FIG. 3A, such an arrangement thereby defines a plurality of substantially rectangular exit passages (32A) in at least the region of, (that is to say, in the front of, or downstream of) the nozzle exit orifice (15) from which the liquid composition exits. According to the configuration depicted in FIG. 3, a maximized high foaming spray effect is provided according to this relative positioning of the first fitment element (16) and second fitment element (23).

Figure 4A:
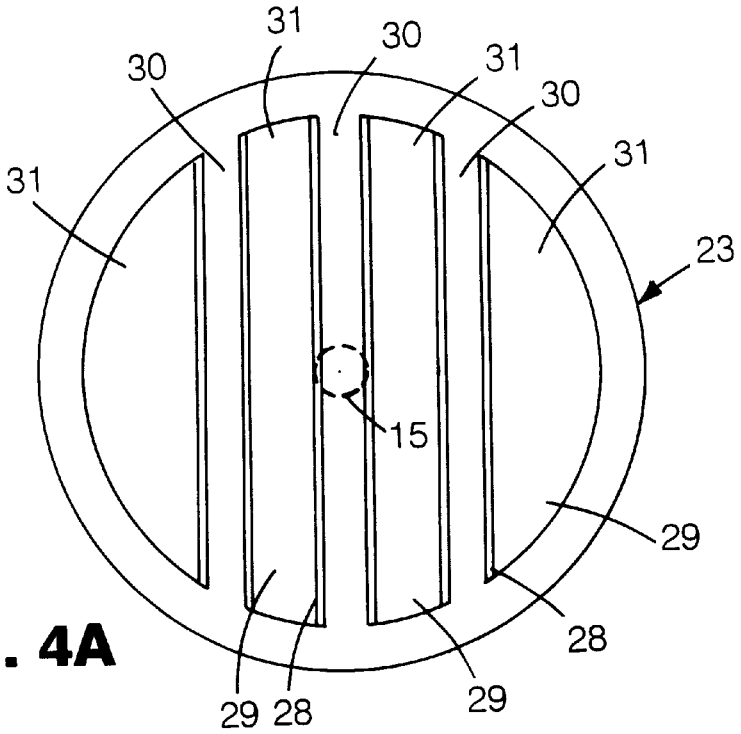
FIG. 4A illustrates in an end view an alternative embodiment of fluid flow modifying elements illustrated on FIGS. 2 and 3A in a second orientation relative to each other.

A second orientation of the apparatus of FIG. 3A is depicted in FIG. 4A. Therein, as can be seen, the second fitment element (23) is positioned such that the transverse beams (30) and transverse passages (31) defined therebetween overlap (and in this figure partially obscure) the corresponding transverse beams (28) and transverse passages (29) of the first fitment element (16). As such, the fluid composition exiting the nozzle exit orifice (15) is provided with a lesser obstructed passage permitting the exit of the fluid composition to be delivered in its most fluid stream-like delivery pattern.

Of particular note is that in the embodiment illustrated in FIG. 3A and 4A, the relative widths of the transverse beams of the first fitment element (16) and second fitment element (23), respectively indicated as "P2" and "P1" in FIG. 3A are not the same width, such that the value P2need not equal P1. Similarly, the width of the transverse passages of the first fitment element (16) and the width of the transverse passages of the second fitment element (23), respectively indicated as "W2" and "W1" in FIG. 3A need not be the same width, such that the value of W2need not equal W1. In this manner, a plurality of substantially rectangular exit passages (32A) may be defined as indicated hereinbefore.

It will be understood that with reference to any of the embodiments indicated in FIGS. 2, 3, 4, 3A, or 4A, or discussed later in this application, that the widths of each of the transverse passages and/or each the transverse beams need not be of a uniform width. Such is particularly illustrated on FIG. 3A and 4A. In this manner it is contemplated that any first fitment element (16) and/or any second fitment element (23) described within this specification may have transverse passages and/or transverse beams of different widths.

It is further contemplated that the embodiments illustrated indicated in FIGS. 2, 3, 4, 3A, or 4A may be oriented in such a manner to form exit passages which are not substantially square or rectangular as previously described, but may be a polygon or any other form.

Turning now to FIG. 5 therein is depicted a still further alternative embodiment of the present invention. Therein is shown a first fitment element (16) wherein the first fluid flow modifying element is comprised of a plurality of non-parallelly positioned transverse beams (28) and non-parallelly oriented transverse passages (29). According to this embodiment, the annular locking element (22) takes the form of a circumferential recess or groove encircling the exterior of the side wall (17). Vent passages (20) are also provided. The second fitment element (23) incorporates in its construction the second fluid flow modifying element which is comprised of non-parallelly positioned transverse beams (30) in conjunction with non-parallel transverse passages (31). There is further provided a locking element (27), an inwardly directed raised ring element which is adapted to be engaged within at least a part of the annular locking element (22). Further, although not necessarily readily apparent from FIG. 5, the second fitment element (23) is of a dimension such that when it is engaged upon the first fitment element (16) the transverse beams (28) and the transverse beams (30) are in a parallel, spaced apart relationship relative to each other, i.e., they are non-contacting. In accordance with this second preferred embodiment of the invention, variations in the fluid delivery patterns may be achieved by varying the positions of the first fluid flow modifying element with second fluid flow modifying element, which is accomplished by rotating said the first and second fitment elements with respect to one another. According to FIG. 6, there is depicted a first positional relationship between the transverse beams (28) of the first fitment element with the transverse beams (30) of the second fitment element. According to FIG. 7 illustrates a still further orientation of the transverse beams (28) of the first fitment element with the transverse beams (30) of the second fitment element (30). FIGS. 6 and 7 illustrate only two possible positional relationships; it is to be understood that rotation of the second fitment element with respect to the first provides infinite variability in the positional relationships of the first and second fluid flow modifying elements. Such variation in positional relationship also provides variation in the fluid delivery characteristics of the liquid composition dispensed.

Still Further alternative embodiments of the invention include those depicted on FIGS. 8, 9, 10 and 11.

Figure 8:
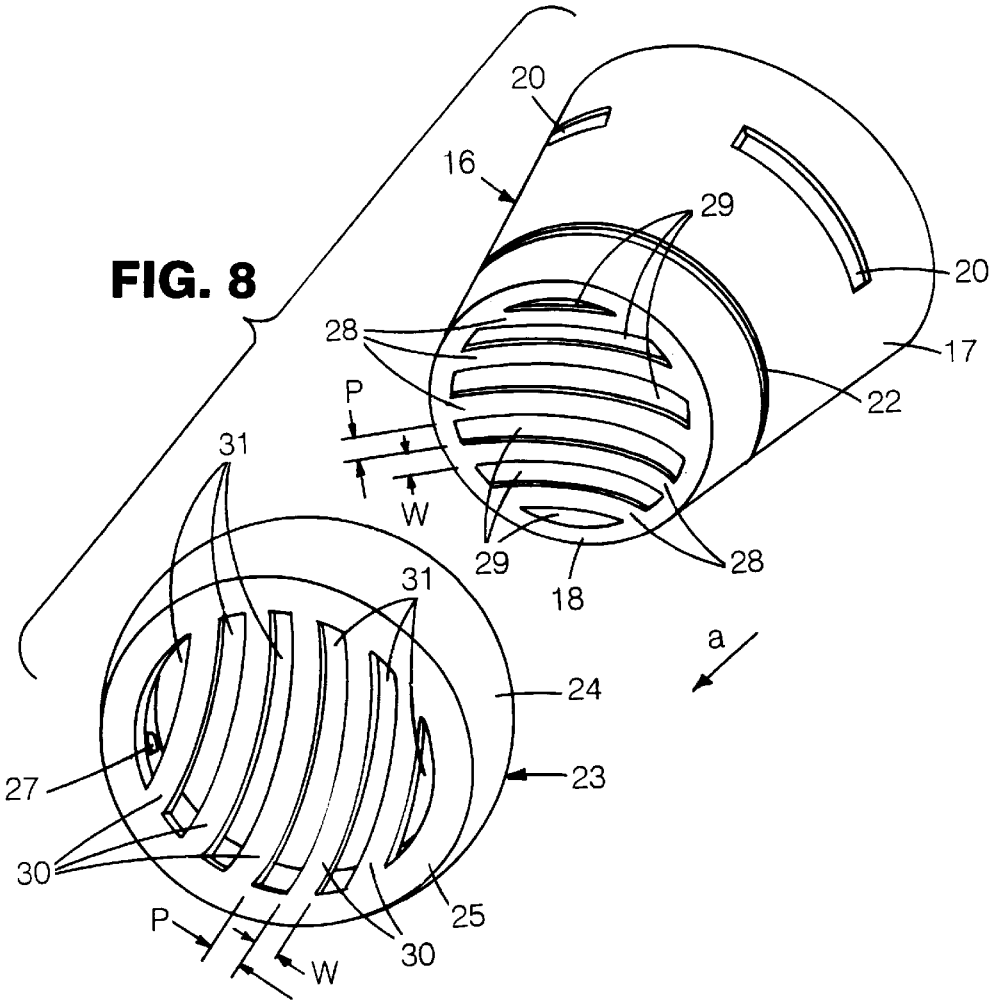
FIG. 8 illustrates in a perspective view a third preferred embodiment of the first fluid flow modifying element and the second fluid flow modifying element according to the invention.

FIG. 8 illustrates in a perspective view a third preferred embodiment of the first fluid flow modifying element and the second fluid flow modifying element according to the invention. As is shown therein, there is depicted an expanded, perspective view of a first fitment element (16) and second fitment element (23). As is more clearly seen, the end (18) incorporates therein the first fluid flow modifying element which is comprised of inwardly extending or concave transverse beams (28) in conjunction with the intermediate transverse passages (29). As may be seen according to this preferred embodiment, these concave transverse beams (28) are parallel with respect to one another and are in the form of parallelly spaced apart arcuate chords which extend across the circular cross-section of the end (18) and bridge the side wall (17). Each of these concave transverse beams (28) illustrated in FIG. 8 is of a uniform width having a dimension "w", and similarly the transverse passages intermediate the transverse beams also have a width "p". The width of each of these concave transverse beams (28) as well as the width of the transverse passages (29) is substantially uniform, and "w" is approximately equal to "p". Turning now to the second fitment element (23), therein is also provided a side wall (24) which is dimensioned to encase a portion of the side wall (17) of the first fitment element (16), an end (25) wherein said end (25) incorporates in its construction the second fluid flow modifying element (26). Said second fluid flow modifying element comprises a plurality of parallelly spaced apart concave transverse beams (30) and further comprises a plurality of transverse passages (31). Each of these concave transverse beams (30) illustrated in FIG. 8 is of a uniform width having a dimension "w", and similarly the transverse passages (31) intermediate the transverse beams also have a width "p". The width of each of these concave transverse beams (30) as well as the width of the transverse passages is substantially uniform, and "w" is approximately equal to "p". Also seen in FIG. 8 is an exemplary locking element (27), here having the form of an inwardly extending tab element dimensioned to engage and to mate with at least a part of the annular locking element (22) of the first fitment element (16). With regard to the first fitment element, there is also depicted the most preferred embodiment of the locking groove (22), herein depicted as a circumferential recess extending about the exterior of the side wall (17). The first fitment element also includes a plurality of vent passages (20) passing through the side wall (17).

In use, the second fitment element (23) is pushed upon the first fitment element such that the locking element(s) (27) are engaged within the annular locking element (22). This provides a rotatable mechanical connection between the respective first and second fitment elements (16), (23). Thereafter, the first fitment element (16) is desirably affixed to a part of the manually operable pump mechanism (5) such that first and second flow modifying elements are substantially perpendicular to the direction of the fluid stream exiting the nozzle orifice of the said pump mechanism (5). At the same time, the concave transverse beams (30) of the second fitment element (23) are assembled in a close corresponding relationship, or nested, with respect to the concave transverse beams (28) of the first fitment element (16). These concave transverse beams (28, 30) are both inwardly directed, which is to be understood that their concavity extends inwardly form their respective ends (18, 25) towards the nozzle and opposite to the direction of flow of the liquid to be dispensed, which direction is indicated by the arrow "a" in FIG. 8. This is more clearly depicted on FIG. 9. Affixation of the assembled first and second fitment elements (16), (23) to the pump mechanism (5) may be accomplished by a variety of conventional means such as having locking or mating elements on a part of the first fitment element which match or mate into a part of the manually operable pump mechanism, or for example, a portion of the assembled first fitment element (16) may be glued to a respective portion of the manually operated pump mechanism (5).

Figure 9:
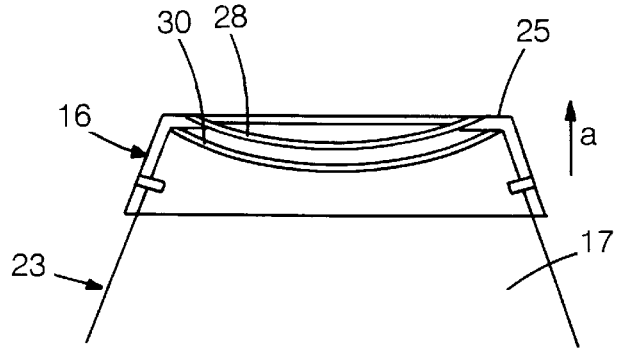
FIG. 9 illustrates in a partial cross sectional view the first fluid flow modifying element and the second fluid flow modifying element according to FIG. 8.

In use, the first fluid flow modifying element and the second fluid flow modifying element according to the invention and depicted on FIGS. 8 and 9 are used in essentially the same manner as is described with relation to the elements described on FIGS. 2 and 3, above. Also, as noted previously it is to be understood that the widths of each of the transverse passages and/or each the transverse beams need not be of a uniform width. In this manner it is contemplated that any first fitment element (16) and any second fitment element (23) described herein may have transverse passages of different widths, as well as transverse beams of different widths.

Turning now to FIG. 9 therein is illustrated in a partial cross sectional view the first fluid flow modifying element and the second fluid flow modifying element according to FIG. 8. Therein the first fitment element (16) is moveably mounted on the second fitment element (23) by means of two pin shaped or tab shaped locking elements (27) which engage the locking ring (22) (not shown) which is in the shape of a circumferential grove on exterior of the wall (17). Specifically shown in this view are concave transverse beams (28) and concave transverse beams (30) all of which are inwardly extending, i.e., opposite the direction of fluid flow as depicted by the arrow "a".

As may be seen, in this depiction the concave transverse beams (28) and concave transverse beams (30) are not in contact with each other, but are spaced apart from each other. It is to be understood however that the dimensions of either the first fitment element (16) and/or the second fitment element (23) may be modified such that at least part of the concave transverse beams (28) contact at least part of the and concave transverse beams (30). This is particularly true wherein the concave transverse beams (30) may have a shorter or smaller radius than those of the concave transverse beams (28). The reverse is also true wherein the end concave transverse beams (28) have a shorter or smaller radius than those of the concave transverse beams (30). In either of such proposed embodiments it is contemplated then that only part of concave transverse beams of the first fitment element (16) and of the second fitment element (23) remain in contact with each other.

Figure 10:
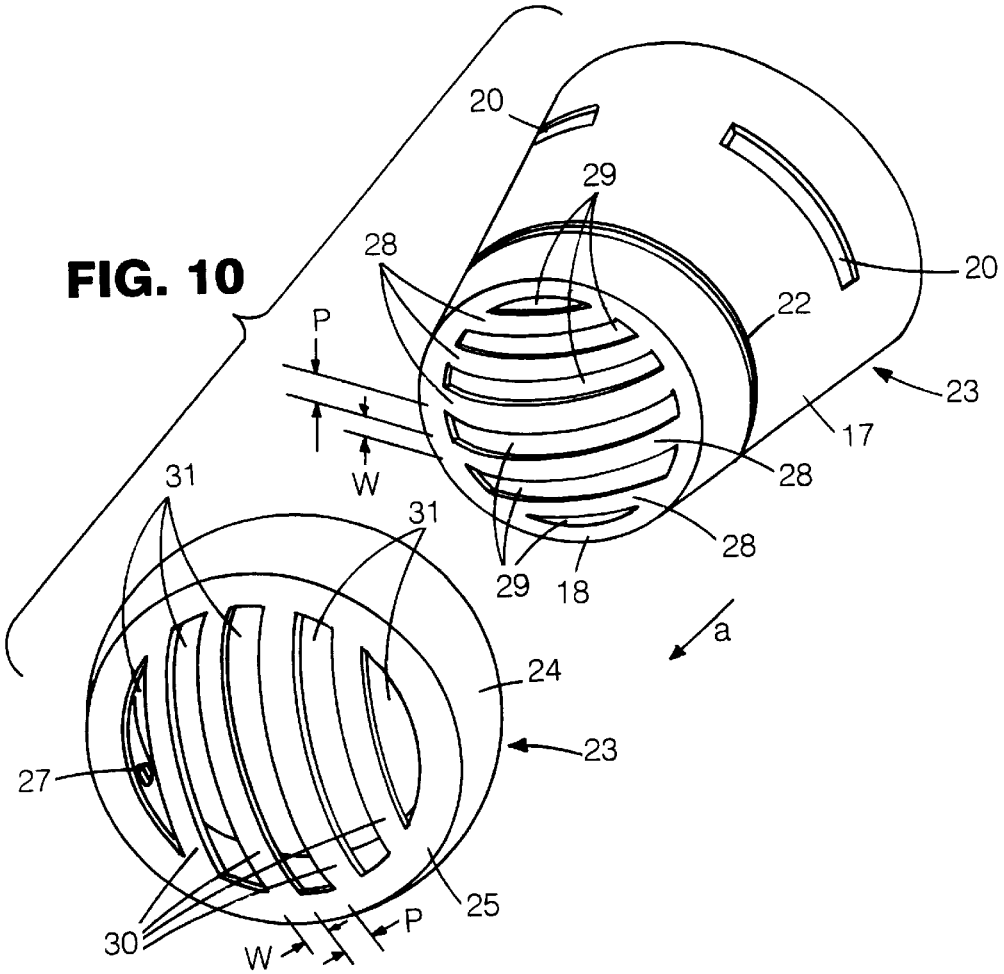
FIG. 10 illustrates in a perspective view a fourth preferred embodiment of the first fluid flow modifying element and the second fluid flow modifying element according to the invention.
Figure 11:
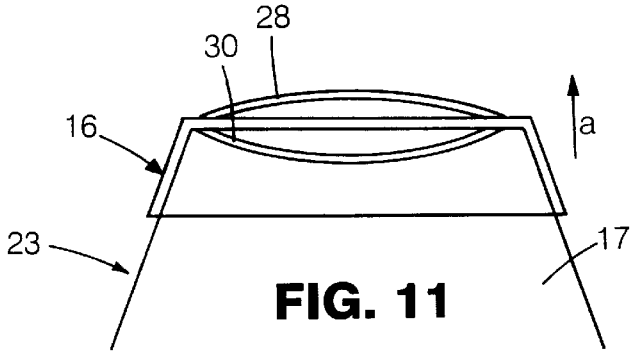
FIG. 11 illustrates in a partial cross sectional view a further embodiment of the invention wherein the first fluid flow modifying element as shown in FIG. 8 is used in conjunction with a second fluid flow modifying element according to FIG. 10.

With regard to FIGS. 10 and 11 therein is illustrated in a perspective view a third preferred embodiment of the first fluid flow modifying element and the second fluid flow modifying element according to the invention. As is shown therein, there is depicted an expanded, perspective view of a first fitment element (16) and a second fitment element (23) according to the third preferred embodiment of the present invention. With regard to the first fitment element, there is also depicted the as locking means (22) a circumferential recess extending about the exterior of the side wall (17). As is more clearly seen, the end (18) incorporates therein the first fluid flow modifying element which is comprised of inwardly extending or concave transverse beams (28) in conjunction with the intermediate transverse passages (29). As may be seen according to this preferred embodiment, these concave transverse beams (28) are parallel with respect to one another and are in the form of parallelly spaced apart arcuate chords which extend across the circular cross-section of the end (18) and bridge the side wall (17). Each of these transverse beams (28) illustrated in FIG. 10 is of a uniform width having a dimension "w", and similarly the transverse passages (29) intermediate the transverse beams (28) also have a width "p". The width of each of these concave transverse beams (28) as well as the width of the transverse passages are substantially uniform, and "w" is approximately equal to "p". Turning now to the second fitment element (23), therein is also provided a side wall (24) which is dimensioned to encase a portion of the side wall (17) of the first fitment element (16), an end (25) wherein said end (25) incorporates in its construction the second fluid flow modifying element. Said second fluid flow modifying element comprises a plurality of parallelly spaced apart convex transverse beams (30) and further comprises a plurality of transverse passages (31). Each of these convex transverse beams (30) illustrated in FIG. 10 is of a uniform width having a dimension "w", and similarly the transverse passages (29) intermediate the convex transverse beams (30) also have a width "p". The width of each of these convex transverse beams (30) as well as the width of the transverse passages (29) are substantially uniform, and "w" is approximately equal to "p". Also seen in FIG. 10 is an exemplary locking element (27), here having the form of an inwardly extending tab element dimensioned to engage and to mate with at least a part of the annular locking element (22) of the first fitment element (16). It is to be understood that desirably two or more such locking elements (27) are present, although this is not depicted. Also, depicted on FIG. 10 are vent passages (20) passing through the wall (17) of the first fitment element (16).

In use, the second fitment element (23) is pushed upon the first fitment element such that the locking element(s) (27) are engaged within the annular locking element (22). This provides a rotatable mechanical connection between the respective first and second fitment elements (16), (23). Thereafter, the first fitment element (16) is desirably affixed to a part of the manually operable pump mechanism (5) such that first and second flow modifying elements are substantially perpendicular to the direction of the fluid stream exiting the nozzle orifice of the said pump mechanism (5). According to this arrangement, and more clearly depicted on FIG. 11, the convex transverse beams (30) of second fitment element (23) and the concave transverse beams (28) of the first fitment element (16) are positioned within and substantially perpendicular to the direction of flow of the liquid to be dispensed. This direction is indicated by the arrow "a" in the Figure.

In use, the first fluid flow modifying element and the second fluid flow modifying element according to the invention are used in essentially the same manner as is described with reference to the elements described on FIGS. 2 and 3, above. Again, as noted previously it is to be understood that the widths of each of the transverse passages and/or each the transverse beams need not be of a uniform width. In this manner it is contemplated that any first fitment element (16) as well as any second fitment element (23) described herein may have transverse passages as well as transverse beams of different widths.

Turning now to FIG. 11 thereon is illustrated in a partial cross sectional view of the embodiment of the invention shown on FIG. 10. As is to be understood from FIG. 11, although certain specific elements are omitted for the sake of clarity in the figure, the first fitment element (16) is rotatably moveably mounted on the second fitment element (23). Specifically shown in this view are inwardly extending, concave transverse beams (28) of the first fitment element (16) and the outwardly extending, convex transverse beams (30) of the second fitment element (23), both of which are substantially perpendicular to the direction of fluid flow of the pump apparatus. As is shown in this embodiment of the invention, the use of fitment elements having transverse beams extending in opposite directions provides for the formation of a "mixing chamber" intermediate the inwardly extending, concave transverse beams (28) of the first fitment element (16) and outwardly extending, convex transverse beams (30) of the second fitment element (23).

The apparatus according to the invention, especially the first fitment element and the second fitment element may be produced from a variety of known conventional materials, and due to low cost and ease of fabrication are desirably produced from naturally occurring or synthetically produced polymeric materials. Preferred synthetic polymeric materials are those which are expected to be generally less prone to degradation when in contact with the types of liquid compositions which may be dispensed. Exemplary materials include polyolefins, including polyethylene, polypropylene, polybutylene, etc., polyamides, including various grades of nylons, styrene, polyacrylates, polysulfones, polyvinylchloride, as well as blends, and copolymers of one or more such polymeric materials or those containing one or more such polymeric materials.

With regard to the respective dimensions of the transverse beams and transverse passages as described herein, it is to be clearly understood that the relative dimensions as depicted in the figures are by purposes of illustrations of certain preferred embodiments of the invention that variation are expected to be within the purview of the skilled practitioner consequent to the understanding of the present invention. For example variations in the number, as well as variation in the intermediate spacing between the transverse beams of the respective first and second fitment elements are possible. Similarly, variations in the number and dimensions of the transverse passages which form part of the first and/or second fitment elements are also possible. Further, it is to be understood that the vent passages (20) passing through the side wall (17) may be of different shapes than those shown in the figures or may be totally omitted from the ultimate apparatus. Also, the patterns of transverse beams may differ between a respective first and second fitment elements and need not be matching or even similar. Additionally, the dimensions of transverse beams and/or transverse passages of the first and/or second fitment elements need not be the same, and may differ from one another. It is further contemplated that the dimensions of each of transverse beams and/or transverse passages need not be the same within the first fitment element and/or within the second fitment element.

With regard to the transverse beams, it is also to be understood that they may be of different cross-sectional configurations and need not be substantially rectangular or square as depicted in the figures appended hereto. Thus, it is to be understood that the transverse beams may be, for example, circular, triangular, elliptical, or any of a number of other known geometrical cross-sectional configurations. However, the present inventors have found that the substantially rectangular or square cross-sectional shaped transverse beams as depicted in the figures are particularly useful in that the comers of such cross-section provide sharp edges which aid in the inducement of turbulent flow and good foaming characteristics of the fluid being delivered.

With regard to further embodiments of fluid flow modifying elements which are also to be understood to be within the scope of the present invention, certain variations are clearly contemplated although not depicted on the Figures. Particularly it is contemplated that one of the fluid flow modifying elements may be substantially planar, such as according to FIG. 2, while the other fluid flow modifying element may be either concave such as depicted on FIG. 9, or convex, such as depicted on FIG. 10.

With regard to the overall appearance of the invention, it is to be understood that although the end view of the first fitment element (16) and the exterior of the second fitment element (23) have been illustrated to be circular in cross section (as is apparent FIG. 2, etc.) it is to be understood that the first and/or second fitment elements be of different configurations including any desired polygonal (square, triangle, rectangular, pentagonal, hexagonal) shape, as well as any circular, semi-circular or elliptical shape in cross section. This may be very desirable for the second fitment element (23) whose exterior may be of a non-circular geometric shape, such as a square, rectangle, pentagon or hexagon in which would facilitate gripping by the user of the device.

The dimensions of the first fluid flow modifying element and the second fluid flow modifying element are optimally determined from known fluid flow principles and other means available to the skilled practitioner in the relevant art. Similarly, the number of transverse beams for the first fitment element and/or second fitment element may be any number which is found suitable for use. Advantageously, at least one, but desirably at least three transverse beams for the first fitment element and second fitment element are present. Further, the widths of the transverse beams and the dimensions of the transverse passages may also be selected to be any which is found suitable for use. Advantageously, the widths of transverse beams are between about 0.001 inches (0.025 mm) and 0.5 inches (12.7 mm), more desirably between about 0.005 inches (0.127 mm) and 0.1 inches (2.5 mm). The widths of transverse passages are desirably between about 0.001 inches (0.025 mm) and 0.5 (12.7 mm) inches, more desirably between about 0.005 inches (0.127 mm) and 0.1 (2.5 mm) inches, and most advantageously between about 0.010 inches (0.25 mm) and 0.050 (1.27 mm) inches. Advantageously, the maximum diameter of the first fitment element according to any of the Figures discussed herein preferably from about 0.25 inch (6.25 mm) to about 1.0 inch (25.4 mm) but more desirably are from about 0.25–0.75 inches (6.25–19.05 mm). According to a first exemplary preferred embodiment of the invention, there is provided an assembly as indicated on FIG. 3 and FIG. 4 having a plurality of substantially transverse beams each having a width of about 0.03 inches (0.76 mm), where the transverse beams define a plurality of transverse passages each having a width of about 0.04 inches (1 mm). According to a second exemplary preferred embodiment of the invention there is provided an assembly as indicated on FIG. 3A and FIG. 4A having a plurality of substantially transverse beams on one fitment element having a width of from about 0.005 inches (0.12 mm) to about 0.010 inches (0.25 mm) and on the other fitment element having a plurality of substantially transverse beams having a width of from about 0.008 inches (0.20 mm) to about 0.015 inches (0.38 mm), and where the transverse beams define a plurality of transverse passages each having a width of at least about 0.010 inches(0.25 mm). In both of these described exemplary preferred embodiment of the inventions there are present at least 3, more desirably from 5–10 transverse beams on both the first fitment element and second fitment element.

It is also to be understood that the improved foaming delivery characteristics which are described herein in conjunction with a manually operable pump apparatus for dispensing a liquid may also be applied to a pressurized dispenser apparatus, particularly an aerosol container for dispensing a liquid. In such an apparatus, the first fluid flow modifying element and the second fluid flow modifying element is interposed within the direction of the exiting fluid flow from the nozzle of the aerosol container. Varying the orientation of the first and second fluid flow modifying elements will vary the amount of foaming imparted to the exiting fluid.

What is claimed is:

1. A manually operable pump mechanism for use in conjunction with a container vessel containing a quantity of a liquid composition, characterized in that said mechanism includes:

a first fitment element which includes a first fluid flow modifying element mounted perpendicular to the flow path of the liquid to be sprayed from the pump mechanism which first fluid flow modifying element comprises a plurality of spaced apart beams having intermediate transverse passages therebetween;

a second fitment element rotatably mountable upon the first fitment element which second fitment element includes a second fluid flow modifying element perpendicular to the flow path of the liquid to be sprayed where the second fluid flow modifying element comprises a plurality of spaced apart beams having intermediate transverse passages therebetween;

wherein the second fitment element is variably rotatable with respect to the first fitment element between a first orientation providing a greater obstructed passage to the exit of the liquid composition, and a second orientation providing a lesser obstructed passage to the exit of the liquid composition.

2. A manually operable pump mechanism according to claim 1 wherein the plurality of spaced apart beams of the first fluid flow modifying element are substantially parallel spaced apart beams.

3. A manually operable pump mechanism according to claim 1 wherein the plurality of spaced apart beams of the second fluid flow modifying element are substantially parallel spaced apart beams.

4. A manually operable pump mechanism according to claim 1 wherein the plurality of spaced apart beams of the first fluid flow modifying element or of the second fluid flow modifying element are substantially coplanar.

5. A manually operable pump mechanism according to claim 1 wherein the plurality of spaced apart beams of the first fluid flow modifying element or of the second fluid flow modifying element are substantially concave with respect to the direction of the liquid to be sprayed from the container.

6. A manually operable pump mechanism according to claim 1 wherein the plurality of spaced apart beams of the first fluid flow modifying element or of the second fluid flow modifying element are substantially convex with respect to the direction of the liquid to be sprayed from the container.

7. A manually operable pump mechanism according to claim 1 wherein the plurality of spaced apart beams of the first fluid flow modifying element or of the second fluid flow modifying element are spaced apart with respect to each other.

8. Means for varying, the spray characteristics of a liquid from a container vessel containing a quantity of a pressurized liquid composition, characterized in that said means includes:

a first fitment element which includes a first fluid flow modifying element mounted perpendicular to the flow path of the liquid to be sprayed from the pump mechanism which first fluid flow modifying element comprises a plurality of spaced apart beams having intermediate transverse passages therebetween;

a second fitment element rotatably mountable upon the first fitment element which second fitment element includes a second fluid flow modifying element perpendicular to the flow path of the liquid to be sprayed where the second fluid flow modifying element comprises a plurality of spaced apart beams having intermediate transverse passages therebetween;

wherein the second fitment element is variably rotatable with respect to the first fitment element between a first orientation providing a greater obstructed passage to the exit of the liquid composition, and a second orientation providing a lesser obstructed passage to the exit of the liquid composition.

9. Means according to claim 8 wherein the plurality of spaced apart beams of the first fluid flow modifying element are substantially parallel spaced apart beams.

10. Means according to claim 8 wherein the plurality of spaced apart beams of the second fluid flow modifying element are substantially parallel spaced apart beams.

11. Means according to claim 8 wherein the plurality of spaced apart beams of the first fluid flow modifying element or of the second fluid flow modifying element are substantially coplanar.

12. Means according to claim 8 wherein the plurality of spaced apart beams of the first fluid flow modifying element or of the second fluid flow modifying element are substantially concave with respect to the direction of the liquid to be sprayed from the container.

13. Means according to claim 8 wherein the plurality of spaced apart beams of the first fluid flow modifying element or of the second fluid flow modifying element are substantially convex with respect to the direction of the liquid to be sprayed from the container.

14. Means according to claim 8 wherein the plurality of spaced apart beams of the first fluid flow modifying element or of the second fluid flow modifying element are spaced apart with respect to each other.

15. A manually operable pump mechanism for use in conjunction with a container vessel containing a quantity of a liquid composition, characterized in that said mechanism includes:

a nozzle, a first fitment element upstream from said nozzle which includes a first fluid flow modifying element mounted perpendicular to the flow path of the liquid to be sprayed from the pump mechanism which first fluid flow modifying element comprises a plurality of spaced apart beams having intermediate transverse passages therebetween;

a second fitment element upstream from said nozzle rotatably mountable upon the first fitment element which second fitment element includes a second fluid flow modifying element perpendicular to the flow path of the liquid to be sprayed where the second fluid flow modifying element comprises a plurality of spaced apart beams having intermediate transverse passages therebetween; element wherein the second fitment element is variably rotatable with respect to the first fitment element between a first orientation providing a greater obstructed passage to the exit of the liquid composition, and a second orientation providing a lesser obstructed passage to the exit of the liquid composition wherein in all orientations of the second fitment element with respect to the first fitment element, the spaced apart beams first fluid flow modifying element do not completely obscure all of the intermediate transverse passages of the second fluid flow modifying element.

16. A manually operable pump mechanism according to claim 15 wherein the plurality of spaced apart beams of the first fluid flow modifying element are substantially parallel spaced apart beams.

17. A manually operable pump mechanism according to claim 15 wherein the plurality of spaced apart beams of the second fluid flow modifying element are substantially parallel spaced apart beams.

18. A manually operable pump mechanism according to claim 15 wherein the plurality of spaced apart beams of the first fluid flow modifying element or of the second fluid flow modifying element arc substantially coplanar.

19. A manually operable pump mechanism according to claim 15 wherein the plurality of spaced apart beams of the first fluid flow modifying element or of the second fluid flow modifying element are substantially concave with respect to the direction of the liquid to be sprayed from the container.

20. A manually operable pump mechanism according to claim 15 wherein the plurality of spaced apart beams of the first fluid flow modifying element or of the second fluid flow modifying element arc substantially convex with respect to the direction of the liquid to be sprayed from the container.

21. A manually operable pump mechanism according to claim 15 wherein the plurality of spaced apart beams of the first fluid flow modifying element or of the second fluid flow modifying element arc spaced apart with respect to each other.

* * * * *

UNITED STATES PATENT AND TRADEMARK OFFICE

CERTIFICATE OF CORRECTION

PATENT NO. : 6,164,565
DATED : December 26, 2000
INVENTOR(S) : Charles Raymond White and Patrick G. Adee It is certified that error appears in the above-identified patent and that said Letters Patent is hereby corrected as shown below:

Title page,
Item "[73] Assignee:", delete "Beneckiser" and insert -- Benckiser --.

Signed and Sealed this

Twenty-third Day of October, 2001

*Attest:*

Nicholas P. Godici

NICHOLAS P. GODICI
*Acting Director of the United States Patent and Trademark Office*

*Attesting Officer*